US005603678A

United States Patent [19]

Wilson

[11] Patent Number: 5,603,678

[45] Date of Patent: Feb. 18, 1997

[54] EXERCISE APPARATUS FOR SIMULATING FREE-WEIGHT SQUAT REPETITIONS

[76] Inventor: Jerry L. Wilson, 570 NE. 53rd Ave., Hillsboro, Oreg. 97124

[21] Appl. No.: 535,781

[22] Filed: Sep. 28, 1995

Related U.S. Application Data

[63] Continuation of Ser. No. 438,987, May 11, 1995, abandoned, which is a continuation of Ser. No. 239,723, May 9, 1994, abandoned, which is a continuation-in-part of Ser. No. 183,471, Jan. 18, 1994, abandoned.

[51] Int. Cl.[6] ..... A63B 23/04

[52] U.S. Cl. ..... 482/97; 482/123; 482/130; 482/137

[58] Field of Search ..... 482/92–103, 112, 482/121, 123, 129, 130, 142, 133–137

[56] References Cited

U.S. PATENT DOCUMENTS

| | | | |
|---|---|---|---|
| 689,688 | 10/1901 | Herz | 482/97 |
| 3,638,941 | 2/1972 | Kulkens | 482/129 |
| 3,659,844 | 5/1972 | Cummins | 482/133 X |
| 4,377,281 | 3/1983 | Jesernig et al. | 482/97 |
| 4,685,670 | 8/1987 | Zinkin | 482/129 |
| 4,915,378 | 4/1990 | Abrahamian et al. | 482/99 X |
| 5,300,005 | 4/1994 | Wang | 482/142 |
| 5,308,306 | 5/1994 | Wang | 482/121 X |

FOREIGN PATENT DOCUMENTS

| | | | |
|---|---|---|---|
| 496740 | 2/1937 | United Kingdom | 482/130 |

*Primary Examiner*—Richard J. Apley
*Assistant Examiner*—John Mulcahy
*Attorney, Agent, or Firm*—Chernoff, Vilhauer, McClung & Stenzel, LLP

[57] ABSTRACT

An exercise apparatus has a platform, including a seat which supports the back and head of the user, that is rotatably attached to a frame that rests on the floor. A pivot arm, which is fixedly attached to the platform and rotatably attached to the frame, allows the platform to move between a first position where the legs of a user lying on the seat are bent approximately 90 degrees at both the knees and at the hips when the user's feet are placed on a leg support that is attached to the frame, and a second position where the user's legs are substantially fully extended. Movement of the platform is resisted by elastomeric weight straps which extend between the frame and the pivot arm or weight plates which are mounted on the platform. The weight straps and weight plates can either be used separately or in combination with one another. Stops limit the travel of the platform so that the platform does not move past its desired first and second positions.

10 Claims, 3 Drawing Sheets

EXERCISE APPARATUS FOR SIMULATING FREE-WEIGHT SQUAT REPETITIONS

RELATED APPLICATIONS

This is a continuation of application Ser. No. 08/438,987 filed May 11, 1995, now abandoned, which in turn is a continuation of application Ser. No. 08/239,723 filed on May 9, 1994, now abandoned, which in turn is a continuation-in-part of application Ser. No. 08/183,471 filed Jan. 18, 1994, now abandoned.

BACKGROUND AND SUMMARY OF THE INVENTION

The subject invention relates to a resistance type exercise apparatus, and in particular to such an apparatus which permits the user to simulate the performance of free-weight squats without the upper body trauma and danger normally associated with this exercise.

The squat is a free-weight exercise in which a barbell is placed on a user's shoulders directly behind the neck and is supported by the arms while the user first lowers his or her body by bending the legs to approximately 90 degrees at the knees and hips and then raises his or her body by restraightening the legs. This exercise is probably the most effective exercise for overall building of lower body muscles and often is used by experienced weight lifters. However, this exercise is one of the most painful and traumatic exercises since the legs are capable of lifting a large amount of weight and yet the weight must be supported by the lifter's arms and shoulders. In addition, it is one of the most dangerous exercises since it typically is terminated by placing the barbell on a rack when the lifter's legs are fully extended. Yet as the lifter approaches his or her limit it becomes difficult to obtain this position. Furthermore, the weight tends to throw lifters forward and cause them to lose their balance. Thus, it is usually necessary to have two spotters when performing the squat. As a result, this exercise is frequently not used by anyone but very experienced weight lifters. Even then the weight used is often less than what the legs are capable of lifting and thus less than maximum affect is achieved.

While exercise apparatus have been developed to perform the squat, the prior art devices of this type are complex and expensive. They also utilize cables and cams or a similar mechanism to lift the weights used for resistance. Thus, the weights are raised and lowered on every repetition which must be done at a rather slow speed and they provide little aerobic affect. A typical prior art squat apparatus is disclosed in Jones, U.S. Pat. No. 4,511,137.

The subject invention overcomes the shortcomings of the prior art by providing an exercise apparatus in which a platform, having a seat that will support the back and head of a user of the apparatus, is rotatably mounted to a frame which sets on the floor. This is accomplished through a pivot arm that is fixedly attached to the platform and rotatably attached to the frame. The platform and pivot arm are arranged so that the platform moves between a first position where the legs of a user who is laying on the seat are bent approximately 90 degrees at both the knees and hips when the user's feet are placed on a leg support that extends upwardly from the base, and a second position where the user's legs are substantially fully extended. A resistance device resists movement of the platform between its first and second positions.

In a preferred embodiment of the invention the resistance device is elastomeric weight straps that extend between the base and the pivot arm and weights that are removably mounted on the platform. These two types of resistance devices can either be used separately or in combination with one another. Because weights provide a constant resistance over the entire range of travel of the platform and weight straps provide a variable resistance, different results are achieved depending on which type of resistance is utilized. In addition, if both types of resistance are utilized, different results are achieved depending on the relative amount of each. The preferred embodiment also provides stops which limit the travel of the platform past the desired first and second positions.

Regardless of what type of resistance device is used, the apparatus eliminates the necessity of carrying a barbell with the shoulders and arms and thus eliminates the pain and upper body trauma normally associated with performing squats. For the same reason, the risk of injury is also eliminated. Finally, the rotating platform provides a momentum which permits repetitions to be formed at a faster pace than with free weights which results in an aerobic affect far in excess of that obtainable with free weights.

The foregoing and other objectives, features, and advantages of the invention will be more readily understood upon consideration of the following detailed description of the invention, taken in conjunction with the accompanying drawings.

DETAILED DESCRIPTION OF THE DRAWINGS

DETAILED DESCRIPTION OF A PREFERRED EMBODIMENT

Figure 1:
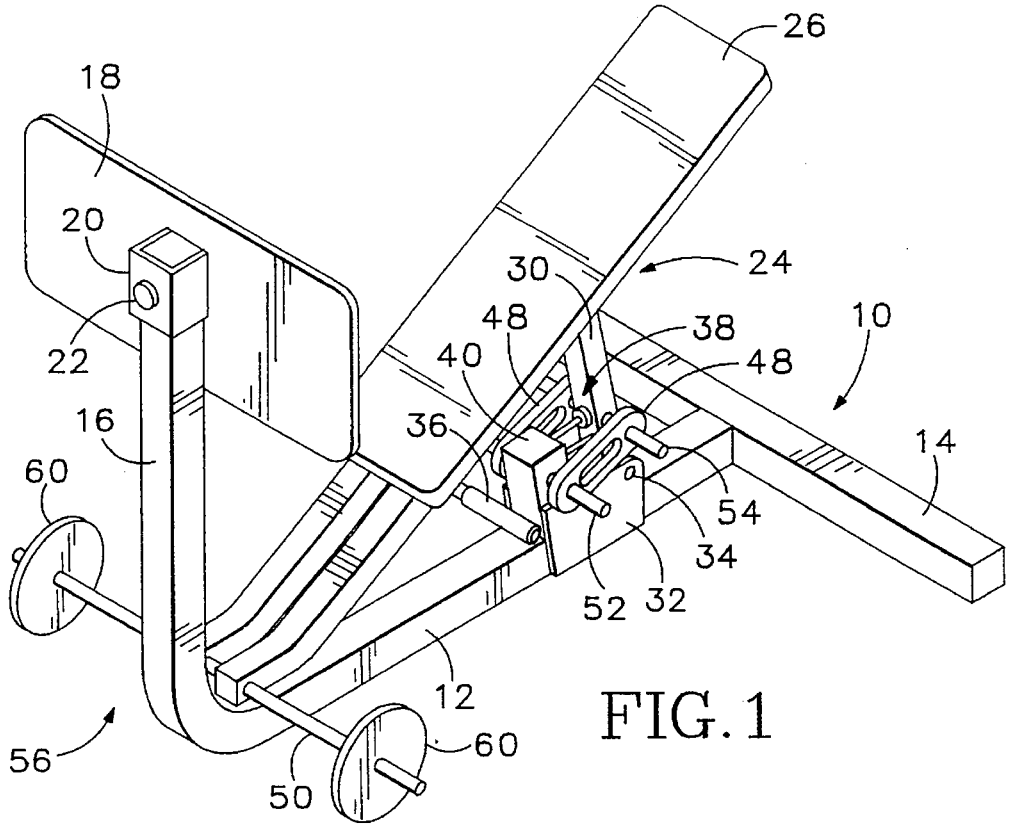
FIG. 1 is a perspective view of an exercise apparatus embodying the subject invention.

Referring to FIG. 1 of the drawings, a preferred embodiment of the exercise apparatus of the subject invention includes a frame 10 which rests on the floor and serves as a base for the apparatus. The base includes a longitudinal element 12 with a lateral element 14 attached to one of its ends. The resulting t-shape provides stability against tipping without excess weight which allows the apparatus to be moved by one person. A vertical element 16 extends upwardly from the end of the longitudinal element. In the embodiment illustrated all of the frame elements are made from rectangular steel tube and the longitudinal element and vertical element are a unitary piece of tube which is bent 90 degrees. The lateral element is attached to the longitudinal element by means of welding.

A rectangular foot support 18 is mounted on the vertical element 16. Preferably the foot support includes a collar 20 which slidably fits on the vertical support. A set screw 22 extends through the collar into contact with the vertical element to secure the foot support to the vertical element at the proper location.

Figure 2:
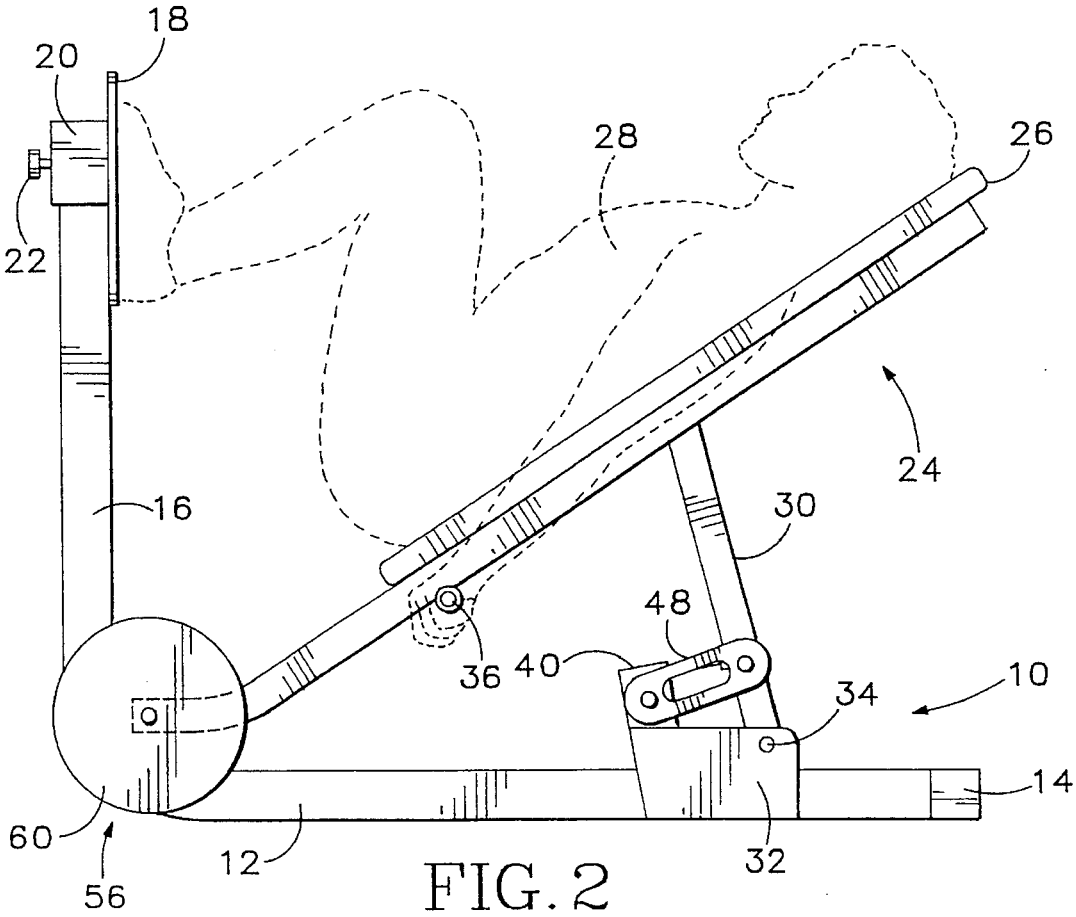
FIG. 2 is a side elevation view of the exercise apparatus of FIG. 1 in a first position with a user shown in phantom line.
Figure 3:
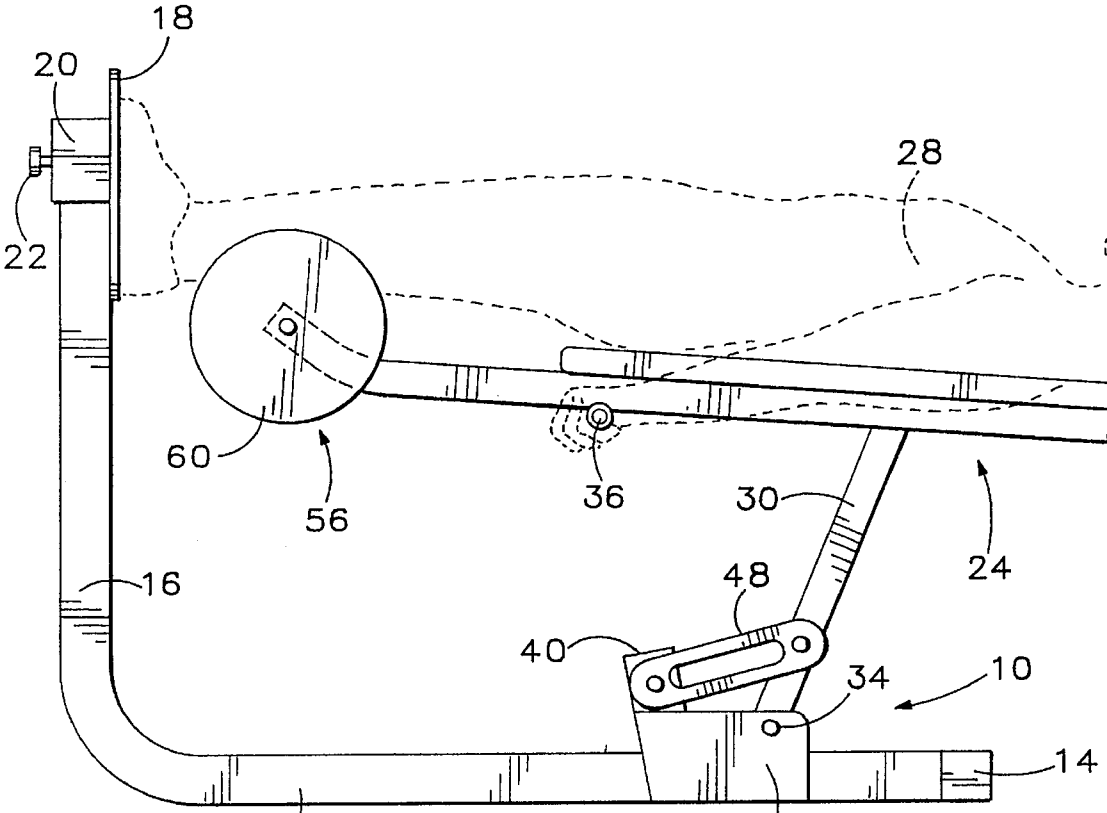
FIG. 3 is a side elevation view of the exercise apparatus of FIG. 1 in a second position with a user shown in phantom line.

Located above the longitudinal frame element 12 is a platform 24 which includes a seat 26 at the end farthest from the vertical element 16. As can be seen in FIGS. 2 and 3, the seat 26 has a length and width which permits it to support the head and back of a person 28 who is using the apparatus. The platform is attached to the frame 10 through a pivot arm 30. One end of the pivot arm is fixed to the platform and the other end is rotatably attached to the frame by means such as plates 32 and pin 34.

The platform and pivot arm are arranged such that the platform will move between a first position, shown in FIG. 2, and a second position, shown in FIG. 3. When in the first position a person 28 positioned on the seat will have his or her legs bent approximately 90 degrees at the knees and at the hips when their feet are positioned on the support 18. A shorter person would have to position oneself on the seat 26 closer to the vertical frame element 16 than would a taller person. Handles 36 project from each side of the platform at a location where they can be grasped by the user's hand when the user is so positioned. The platform is moved from this first position to the second position by the user straightening his or her legs until they are substantially fully extended, FIG. 3. By gripping the handles 36 the user will not slide along the seat as this occurs.

Figure 5:
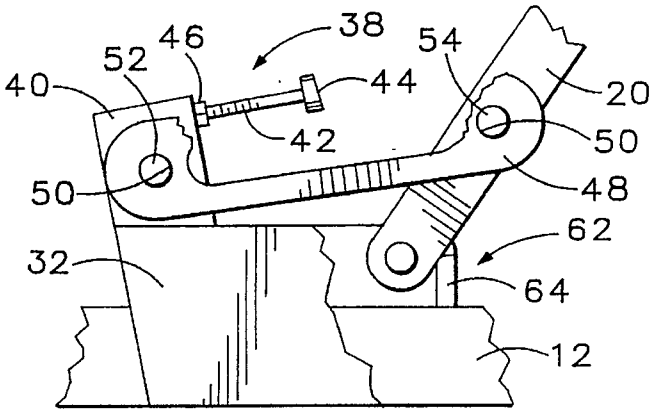
FIG. 5 is a detail view, similar to that of FIG. 4, with the exercise apparatus in its second position.
Figure 4:
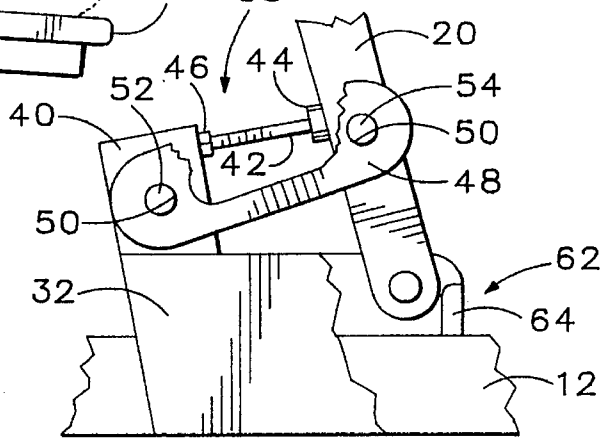
FIG. 4 is a fragmentary detail view, partially broken away to show hidden detail, of a portion of the exercise apparatus in its first position.

Stops are provided to limit the travel of the platform when it is moved between its first and second positions. Referring now also to FIGS. 4 and 5, a forward stop 38 is mounted on a post 40 which projects upwardly from the frame between the plates 32 a short distance in front of the pivot pin 34. The forward stop comprises a threaded rod 42 which fits in a threaded hole in a post 40 and has a pad 44 mounted on its extremity. A locknut 46 on the rod 42 can be tightened against the pivot to lock the rod in its desired position. This arrangement permits adjustment of how far the platform can be moved in the forward direction, for reasons that will be explained later. A rear stop 62 comprises a bar 64 which extends between the plates 32 immediately behind the pivot pin 34. The height of the bar 64 is set to engage the pivot arm 30 when the platform is at the desired orientation for its second position. While the drawings illustrate the platform at approximately a 30 degree angle with respect to the horizontal when it is in its first position and horizontal when in its second position, these orientations are not exclusive. The illustrated orientations are preferable, however, in providing an apparatus which is comfortable and easy to use.

In order to provide the desired weight lifting effect, resistance is provided against the movement of the platform between its first and second positions. In the drawings, two types of resistance are shown. The first type of resistance is provided by elastomeric weight straps 48. The weight straps have holes at each end. The holes at one end fit over pegs 52 that project from the post 40 and the holes at the other end fit over pins 54 that project from the pivot arm 30. The weight straps and pins are configured such that the weight straps are relaxed, or nearly relaxed, when the platform is in its first position, FIG. 4, and stretched when the platform is in its second position, FIG. 5.

The second type of resistance is provided by a barbell 56 which is attached to the forward extremity of the platform 24. The barbell bar 58 fits through a hole in the platform and weight plates 60 are releasably mounted on the bar. The weight plates rest on the floor when the platform is in its first position. Because different size weights have different diameters, the position of the platform when it is in its first position will vary from weight to weight. For this reason, the forward stop 38 is adjustable so that it can be made to engage the pivot arm just before the plates strike the floor regardless of the size of plates that are used.

The weight straps and weight plates can be utilized separately or in combination. The weight plates provide a constant resistance throughout the travel of the platform and the weight straps provide a variable resistance. Thus, a different feel is provided depending on which arrangement is used. While a resistance device, such as weight straps or plates, which is two way and provides resistance when the platform is being moved in both directions is preferable, one way resistance devices, such as a piston cylinder could be utilized.

Figure 6:
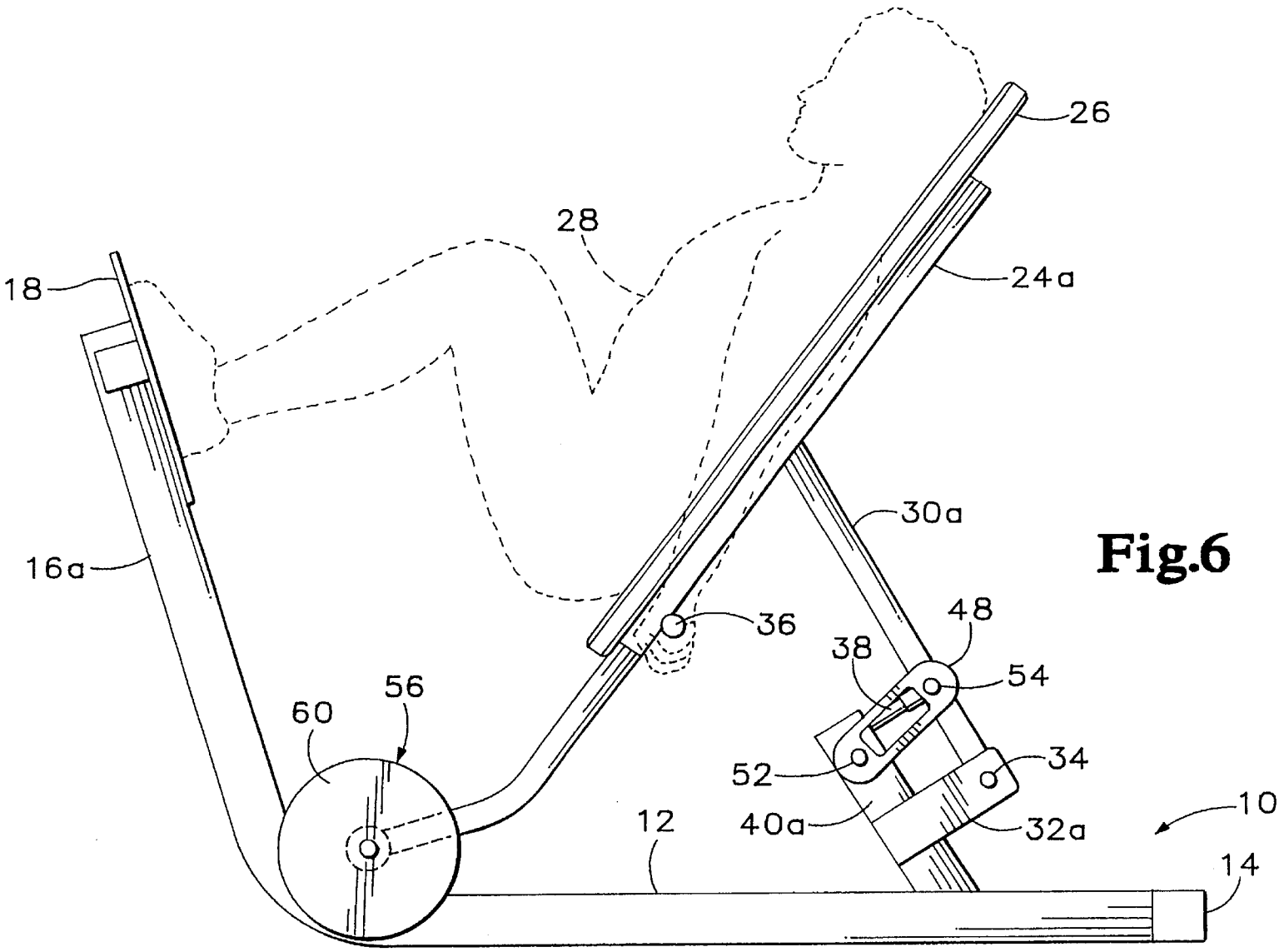
FIG. 6 is a side elevation view, similar to FIG. 2, of an alternate embodiment of the invention.

In an alternate embodiment of the invention, shown in FIG. 6, the vertical element **16*a* is angled slightly forwardly from the vertical. In the embodiment illustrated the vertical element is offset from vertical by approximately 20°. In addition, the pivot arm 30*a* is slightly larger than the pivot arm 30 in order to place the platform 24*a* at a slightly steeper position than the platform arm 24. This change in the angle of the vertical element and pivot arm make the apparatus more comfortable in use and makes the bends at the user's hips and knees closer to the desired 90° orientation when the apparatus is in its first position. To prevent the pivot arm 30*a* from having to be too long the post 40*a* is made longer than the post 40 and the plates 32*a* are mounted on the post rather than on the horizontal element 12**.

In operation the proper amount of resistance, and the mix between plates and weight straps is selected and appropriate plate 60 and straps 48 are installed on the device. This mix can include weight straps alone, weight plates alone or a combination of the two. Since plates provide a constant resistance and weight straps a variable resistance, the relative portion of the total resistance force attributable to each dramatically affects how the apparatus operates. The user 28 then lies on the seat 26 with his or her feet on the foot support 18 and his or her legs bent at approximately 90 degrees at both the knees and the hips as shown in FIGS. 2 and 6. As indicated above, a shorter user will have to position themselves lower on the seat than a taller user to accomplish this orientation. Once properly situated on the seat the user extends his or her legs to move the platform 24 to its second position, FIG. 3. The user then bends the legs to return to the first position. In order to prevent the user from sliding on the seat as this occurs the user can grip the handles 36, however, this is only necessary at high levels of resistance since friction tends to prevent such sliding.

As can be seen from the drawings, this cycle puts the user through essentially the same range of motion that would occur if he or she were performing a squat repetition with free weights. However, because the user is not supporting the weights with his or her arms and shoulders, but rather all of the weight is absorbed by the legs, the pain and upper body stress normally associated with squats is not present. Furthermore, because the user is not lifting a weight the possibility of injury normally associated with performing squats is not present.

Because of the swinging action, or rocking motion, which is achieved by the user and platform as the apparatus is cycled, a certain amount of momentum occurs. This momentum permits the user to perform repetitions at a higher frequency than is possible with free weights so that exercising with this apparatus is far more aerobic than with free weights.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An exercise apparatus for simulating free-weight squat repetitions, said apparatus comprising:

(a) a frame which sits on a floor and supports the remaining elements of the apparatus;

(b) a platform which is arranged to completely support a user in a supine position, said platform having a head end and a foot end, and an elongate axis which extends between said head end and foot end;

(c) an elongate pivot arm having a first end that is rotatably attached to said frame and a second end that is fixedly attached to said platform; said pivot arm having an elongate axis which is oriented generally normal to the elongate axis of said platform;

(d) said pivot arm allowing rotation of said platform between a first position where said platform is angled with respect to the horizontal with said foot end being lower than said head end, and a second position where said platform is generally horizontal;

(e) a horizontal foot support which is fixedly attached to said frame and is located adjacent to the foot end of said platform immediately above an upper surface thereof, when said platform is in its second position; and (f) a resistance device which extends between said pivot arm and said frame to resist movement of said platform from its first position to its second position.

2. The exercise apparatus of claim 1 wherein said resistant device is at least one elastomeric weight strap.

3. The exercise apparatus of claim 1 including weights which are removably mounted on the foot end of said platform to further resist movement of said platform from its first position to its second position.

4. The exercise apparatus of claim 3 wherein said platform has a length which causes said weights to rest on the floor when said platform is in its first position.

5. The exercise apparatus of claim 1 including stops which limit the movement of said pivot arm in both directions.

6. The exercise apparatus of claim 1 including handles located on said platform intermediate where said pivot arm is attached to said platform and said foot end.

7. The exercise apparatus of claim 1 wherein said pivot arm is attached to said platform approximately midway between its head end and its foot end.

8. An exercise apparatus for simulating free-weight squat repetitions, said apparatus comprising:

(a) a frame which sits on a floor and supports the remaining elements of the apparatus;

(b) a platform which is arranged to completely support a user in a supine position, said platform having a head end and a foot end, and an elongate axis which extends between said head end and foot end;

(c) an elongate pivot arm having a first end that is rotatably attached to said frame and a second end that is fixedly attached to said platform; said pivot arm having an elongate axis which is oriented generally normal to the elongate axis of said platform;

(d) said pivot arm allowing rotation of said platform between a first position where said platform is angled with respect to the horizontal with said foot end being lower than said head end, and a second position where said platform is generally horizontal;

(e) a horizontal foot support which is fixedly attached to said frame and is located adjacent to the foot end of said platform immediately above an upper surface thereof, when said platform is in its second position; and (f) weights which are removably mounted on said foot end of said platform to resist movement of said platform from its first position to its second position.

9. The exercise apparatus of claim 8 wherein said pivot arm is attached to said platform approximately midway between its head end and its foot end.

10. An exercise apparatus for simulating free-weight squat repetitions, said apparatus comprising:

(a) an elongate platform having a head end and a foot end;

(b) a pivot arm having a first end that is fixedly attached to said platform intermediate its ends to form a generally T-shaped support element;

(c) a seat mounted on said platform, at the head end thereof, which will support a user in a supine position;

(d) a frame which sits on the floor;

(e) said pivot arm having a second end that is rotatably attached to said frame in a manner to allow rotation of said T-shaped support element between a first position where said platform is angled with respect to the horizontal with said foot end being lower than said head end, and a second position where said platform is generally horizontal;

(f) a horizontal foot support which is fixedly attached to said frame and is located adjacent to the foot end of said platform immediately above an upper surface thereof, when said platform is in its second position; and (g) a resistance device which resists movement of said platform from its first position to its second position.

* * * * *